US005996834A

United States Patent [19]

Der Kinderen

[11] Patent Number: 5,996,834

[45] Date of Patent: Dec. 7, 1999

[54] STORING OR PACKING DEVICE

[75] Inventor: Johannes Martinus Petrus Der Kinderen, Geldermalsen, Netherlands

[73] Assignee: Vandermolen B.V., Nieuwegein, Netherlands

[21] Appl. No.: 09/087,170

[22] Filed: May 29, 1998

[51] Int. Cl.[6] ..... B65D 37/00

[52] U.S. Cl. ..... 220/520; 206/748

[58] Field of Search ..... 220/520, 507, 220/6, 427; 206/748

[56] References Cited

U.S. PATENT DOCUMENTS

| | | | |
|---|---|---|---|
| 3,337,028 | 8/1967 | Glavan | 206/748 X |
| 4,320,846 | 3/1982 | Meyering et al. | 220/520 |
| 5,370,255 | 12/1994 | Yang | 220/520 X |
| 5,676,253 | 10/1997 | Hsu | 220/520 X |
| 5,676,274 | 10/1997 | Green et al. | 220/520 |

*Primary Examiner*—Steven Pollard
*Attorney, Agent, or Firm*—Dority & Manning

[57] ABSTRACT

A device for storing or packing loose objects comprising a plurality of container elements, each having bottom wall, upstanding side and end walls, and an open upper side, which elements are connected to one another by hinge joints arranged between the side edges of the bottom walls thereof to form a continuous row of elements having a first end and a second end and said elements are so shaped and dimensioned that this row of elements, from its extended position and starting from said first end can be spirally rolled-up into a block of prismatic form in which the open upper element sides are closed-off by wall portions of other elements lying inwardly thereof in said block and engaging said open sides. Abutment means on adjacent elements are provided abutting each other in the extended position and preventing further unrolling of the row of elements.

7 Claims, 3 Drawing Sheets

STORING OR PACKING DEVICE

BACKGROUND OF THE INVENTION

The invention relates to a device for storing or packing loose objects. More particularly, the invention relates to a storing or packing device of the kind comprising a plurality of substantially rigid container elements including a bottom wall having substantially parallel side edges, and end walls and side walls extending upwardly from said bottom wall, said end walls and side walls of said elements having upper edges defining an element upper side, and hinge means hingedly interconnecting said plurality of container elements so as to form a unitary continuous row of said elements.

U.S. Pat. No. 4,320,846 issued to Meyering et al. discloses one such multiple-compartment storing or packing device. The device is provided with a row of hingedly interconnected container elements having a first end and a second end and said element row being moveable between a first extended open position in which said container elements rest on their bottom walls with said element upper sides turned upwardly, and a second, rolled-up closed position in which said element row, starting from said first end thereof, has been spirally rolled up from said first position to form a substantially closed block of prismatic shape comprising polygonal convolutions. In said block, each element, except for said first element, with side turned upwards said first element, is in abutting relation to the adjacent element hingedly connected thereto. In said block each of said majority of elements of varying widths has its said upper side matingly engaged and covered by at least one pre-determined wall portion of corresponding size of at least one element situated radially inwardly thereof.

The container elements of the Meyering et al. storing device are sequentially positioned in the prismatic block. When one desires access to an element it is obligatory to unroll the prismatic block at least until the desired element is exposed. However, in the unrolled first extended open position the container elements should rest on their bottom walls to avoid that the row of elements collapses downwardly. It is not possible to maintain the row in a horizontally extended position without supporting the individual elements. Use of the known device without aid of a supporting surface, such as the floor or a table-top, therefore is extremely awkward.

SUMMARY OF THE INVENTION

It is an object of the present invention to overcome the aforementioned shortcomings associated with the prior art.

This object is achieved by providing a device for storing or packing loose objects, comprising a plurality of substantially rigid container elements of equal length and of varying width. Each of said elements includes a bottom wall having substantially parallel side edges, and end walls and side walls extending upwardly from said bottom wall. Said end walls and side walls of said elements have upper edges defining the element upper side. Hinge means are provided hingedly interconnecting said plurality of container elements so as to form a unitary continuous row of said elements.

Said row of hingedly interconnected container elements has a first end and a second end and said element row is moveable between a first extended open position in which said container elements rest on their bottom walls with said element upper sides turned upwardly, and a second, rolled-up closed position in which said element row, starting from said first end thereof has been spirally rolled up from said first position to form a substantially closed block of prismatic shape. This block comprises polygonal convolutions. In said block each element, except for said first element, with a side turned towards said first element, is in abutting relation to the adjacent element hingedly connected thereto. Further, in said block each of said majority of elements of varying widths has its said upper side matingly engaged and covered by at least one pre-determined wall portion of corresponding size of at least one element situated radially inwardly thereof. Adjacent elements of said row of interconnected container elements comprise abutments means cooperatively abutting each other in the first extended open position. Said abutment means in the said first extended open position allow only a hinged movement of said adjacent elements relative to each other towards the second rolled-up closed position while preventing a further hinged movement in the opposite direction.

Thus a storage and packing device is obtained in which the row of elements in the first extended open position remain horizontally aligned without the need of supporting the separate elements. A user may carry horizontally only one of the elements, whereas the remaining elements keep their horizontal position due to the cooperation between the abutment means of adjacent elements.

In a preferred embodiment the end walls of one of each pair of adjacent elements project toward the other of said adjacent elements to define hinge lips cooperating with pivots located on the end walls of said adjacent element, said pivots at least partially being surrounded by abutment shoulders on said end walls of the adjacent element abutting the hinge lips in the first extended open position of said row of interconnected container elements.

In another embodiment the end walls of one of each pair of adjacent elements comprises hinge lips projecting toward the other of said adjacent elements and cooperating with pivots provided on the other of said adjacent elements, wherein the bottom wall of one of said adjacent elements has a side edge facing the other element and being shaped such that it abuts part of the other element in the first extended open position of said row of interconnected container elements.

According to a further preferred embodiment one of each pair of adjacent elements comprises at least one hook-like means projecting at the element upper side and toward the other adjacent element, wherein the hook-like means in the first extended open position of said row of interconnected container elements engages part of the other element.

In yet another embodiment the hinge means define hinge axes and wherein adjacent elements are interconnected by at least one flexibly connecting means extending at some distance above the respective hinge axis between said adjacent elements, and wherein said connecting means has a length to allow movement of said elements only until reaching the first extended open position, in which position the connecting means is taut.

BRIEF DESCRIPTION OF THE DRAWINGS

The invention will be more readily understood and the further objects and advantages thereof will be more apparent when read in conjunction with the accompanying drawings. In the drawings.

DETAILED DESCRIPTION

Figure 1:
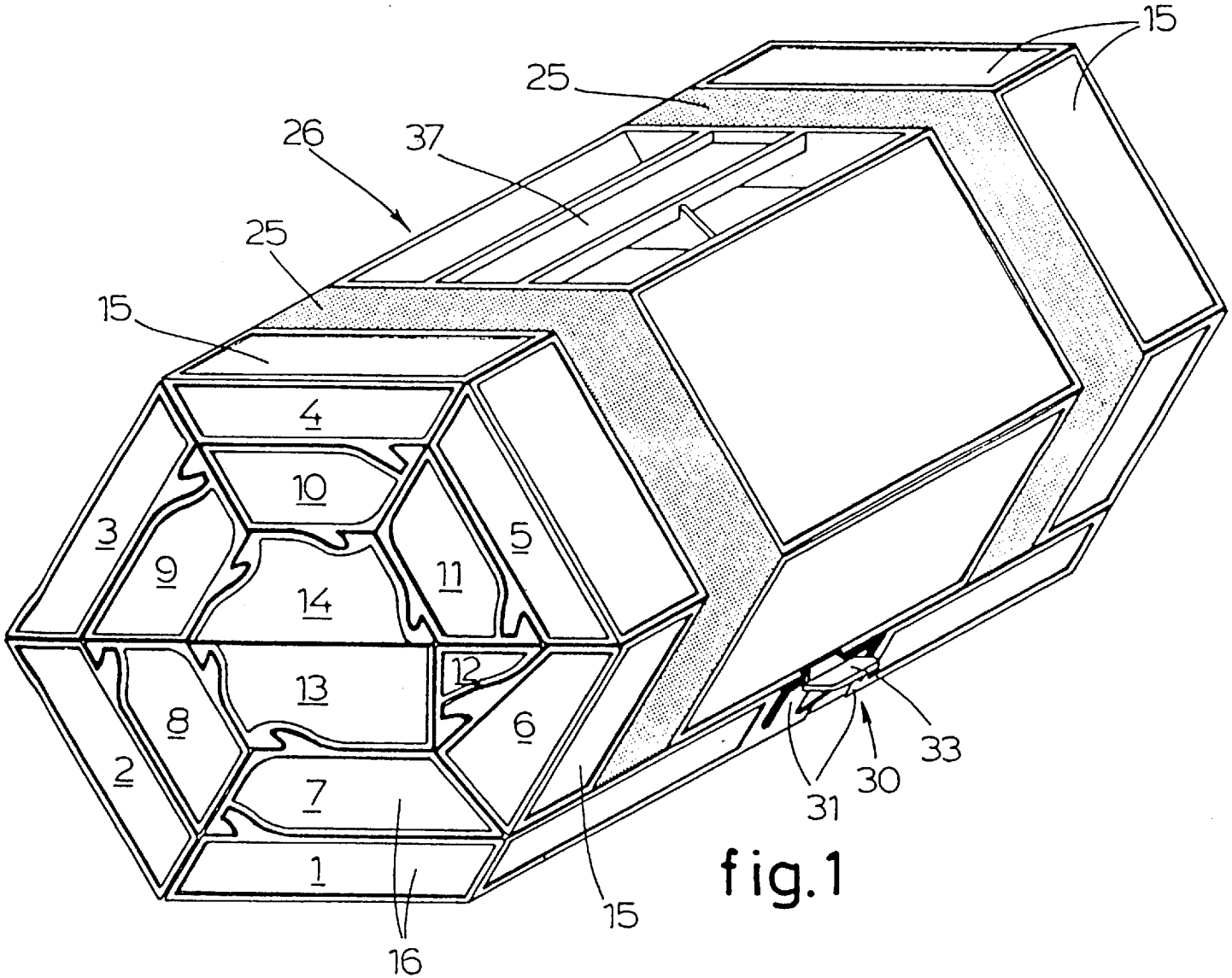
FIG. 1 is a perspective view of a state of the art embodiment of a storing and packing device forming a storage box which, in the rolled-up state, is the shape of a regular hexagonal prismatic block.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiments can be used on another embodiment to yield still a further embodiment. Such modifications and variations are within the scope and spirit of the invention.

Figure 5:
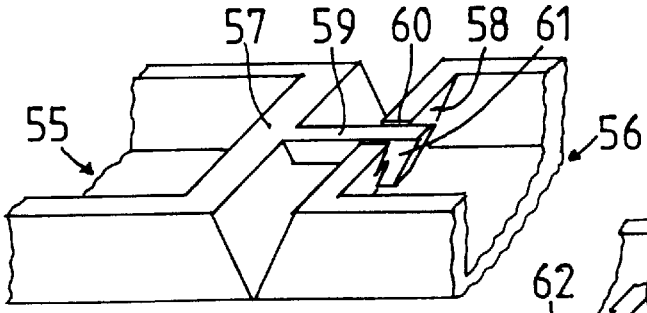
FIG. 5 is a perspective fragmentary end view of another embodiment of the device according to the invention in an unrolled state thereof.
Figure 6:
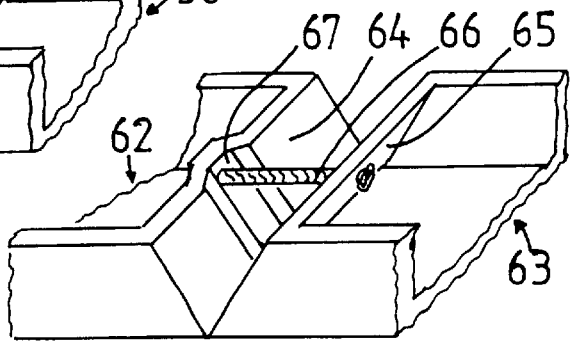
FIG. 6 is a fragmentary perspective view of still another embodiment of the device according to the invention in the rolled-up state thereof.

In the following description firstly a state of the art storing and packing device will be described, illustrating features which apply generally for devices of the type to which the invention refers. It is noted that the device illustrated in FIGS. 1 and 2 only needs to be changed slightly to obtain devices according to the invention as shown in FIGS. 5 and 6.

Figure 2:
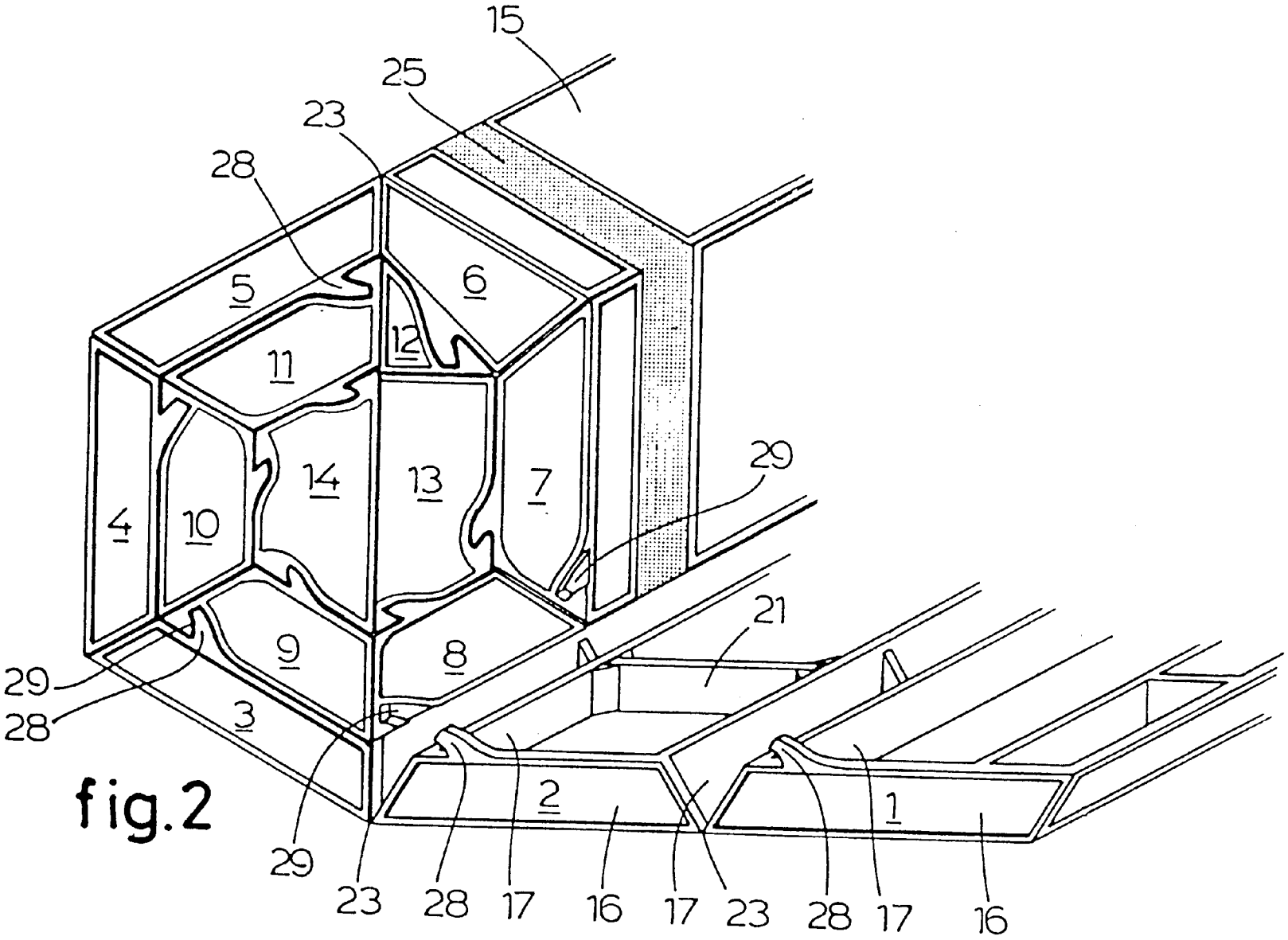
FIG. 2 is a perspective view of the box of FIG. 1 in a partly unrolled state.

The state of the art storage box illustrated in FIGS. 1 and 2 comprises a row of mutually hinge-connected oblong container elements 1–14 of equal length but of differing cross-sections. The container elements each have a flat rectangular bottom wall 15 and end walls 16 extending vertically upward therefrom, which end walls determine the different basic sectional forms of the container elements. The sectional form of the container elements 1–14 differs, as appears readily from FIG. 1 or FIG. 2. The container elements are open on their upper sides and have vertical side walls 17 which connect at the upper corner points of the end walls 16 and consequently join the bottom walls 15 at a short distance from the side edges thereof. The container elements may be divided longitudinally into compartments by vertical cross-partitions 21.

The container elements 1–13 are hingeably joined to one another at adjoining longitudinal edges of the side walls 17 thereof by suitable hinge connections, some of which are indicated by 23. Through this arrangement, the container elements are successively linked together to form a continuous row thereof. In the illustrated known embodiment, the hinge connections between the container elements are constituted by flexible strips 25 (FIGS. 1 and 2), said strips run parallel to one another across the undersides of the bottom walls 15 of the container elements in recesses provided therefor in the latter and to which they are adhesively fixed.

The transverse dimensions and sectional forms of the container elements 1–14 or the end walls 16 thereof, respectively, are chosen such that an initially linearly extended row of container elements can be rolled-up spirally into the form of a closed block 26 of regular hexagonal prismatic form as illustrated in FIG. 1.

For a proper functioning of the described storage box, it is of importance that, during unrolling of the block, the spiral windings of the as yet unrolled portion of the block cannot prematurely open and that during rolling-up of the row of container elements, the already rolled-up container elements cannot again move away from one another. In order to prevent this premature opening, a curved projection or detent 28 is formed on the upper edges of each of the end walls 16 of the container elements, said detent extends obliquely upwardly in the direction in which the row of container elements is unrolled and said detent 28, in the rolled-up position of the row, is fittingly received in a recess or groove 29 formed in the underside of the corresponding end wall 16 of the container element situated radially inwardly thereof. From FIG. 2 it will be seen that the detents 28 and grooves 29 between the other container elements of the still rolled-up portion of the block hold such container elements together and effectively prevent the premature opening of the spiral windings.

A snap-closure 30 is formed in the center of the outwardly directed side wall 18 of the outermost container element 1 of the row of elements. To this end, this side wall 18 is provided with notches extending downwardly from the upper edge thereof to form resilient lips 31 connected at their lower ends to the bottom wall 15 of the container element 1. These lips 31 support an inwardly extending hook portion (not shown) and a sideways extending finger-grip 33. The hook portion extends into an opening in the edge of the bottom wall 15 of the container element 7 and, in its closed condition, grips over a thickened edge portion of this opening. By pushing the grip 33 down with a finger, the lips 31 can be resiliently bent to lift the hook portion from the edge portion, so that the box can be opened to unroll the container elements.

A hand-grip 37 is formed in the container element 4 which lies opposite the outermost container element 1 in the rolled-up block 26. If the closed block-shaped box 26 is picked up by the hand-grip 37 to carry the same and is then again put down, it will thus automatically come to rest on the outermost container element 1 in the correct position for opening the box and unrolling the container elements thereof.

For a more detailed description of the state of the art device, reference is made to U.S. Pat. No. 4,20,846 the subject matter of which is incorporated herein by reference.

When seeking access to the contents of one of the innermost container elements, such as 13 or 14, the row of mutually connected container elements has to be unrolled on a supporting surface, such as the floor or a table top.

It is to be noted that in the following description of preferred embodiments of the storing and packing device according to the invention only those features will be shown and discussed which are considered to be essential for the inventive concept. However, these preferred embodiments of the storing and packing device may be provided with elements which correspond with alike elements of the state of the art device described above. Especially, cooperating projections or detents and grooves corresponding with the state of the art projections or detents 28 and grooves 29, flexible strips defining the hinge connections between the container elements corresponding with the state of the art flexible strips 25 and snap-closures corresponding to the state of the art snap-closures 30 may be provided, although amended, if needed, to be applicable to an inventive device, as will be readily apparent to those skilled in the art. For a proper understanding of the invention it suffices that the novel devices are shown only in a fragmentary perspective end view.

Figure 3A:
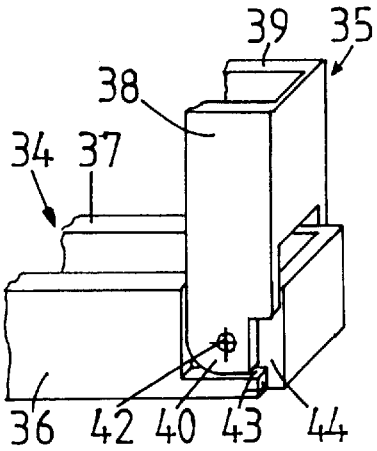
FIGS. 3*a* and 3*b* are fragmentary perspective end views of an embodiment of the device according to the invention in the rolled-up state thereof and unrolled state thereof, respectively.
Figure 3B:
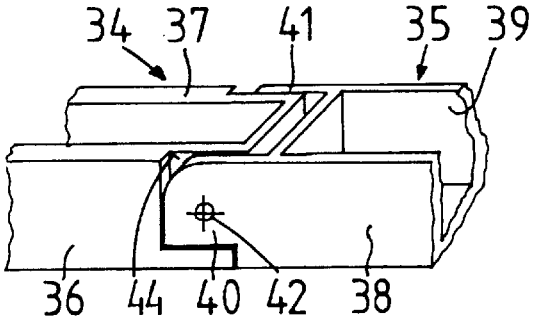

Referring now to FIGS. 3*a* and 3*b*, two adjacent container elements 34 and 35 are illustrated partially. The container elements 34, 35 comprise end walls 36, 37 and 38, 39 respectively. The end walls 38, 39 of element 35 project towards the adjacent element 34 to define hinge lips 40, 41. These hinge lips 40, 41 cooperate with pivots 42 located on the end walls 36, 37 of said adjacent element 34.

Each pivot 42 is partially surrounded by abutment shoulders 43 on the respective end walls 36, 37. In the shown embodiment the abutment shoulders 43 are integrally shaped with each respective end wall 36 and 37, whereas each pivot 42 is located in a recess 44, wherein the transitional surface between recess 44 and respective end wall 36 or 37 functions as abutment shoulders 43.

FIG. 3*a* corresponds with the rolled-up state of the device. In this state the hinge lips 40 and 41 are disengaged from the abutment shoulders 43. In the unrolled state, however, shown in FIG. 3*b* the hinge lips 40 and 41 cooperate with the abutment shoulders 43, such that a hinged movement of the elements 34 and 35 relative to each other beyond the position illustrated in FIG. 3*b* is prevented. Thus adjacent container elements remain horizontally aligned without the need for an additional supporting service such as a table-top or a floor.

Figure 4A:
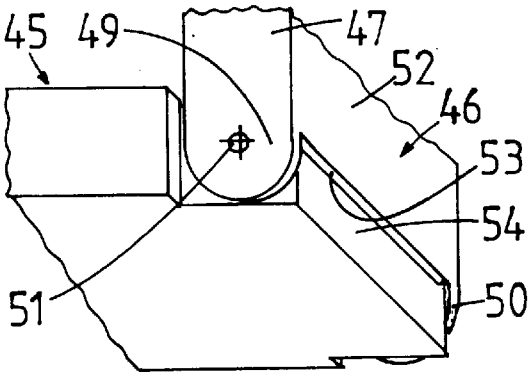
FIGS. 4*a* and 4*b* are fragmentary perspective end views of another embodiment of the device according to the invention in the rolled-up state thereof and unrolled state thereof, respectively.
Figure 4B:
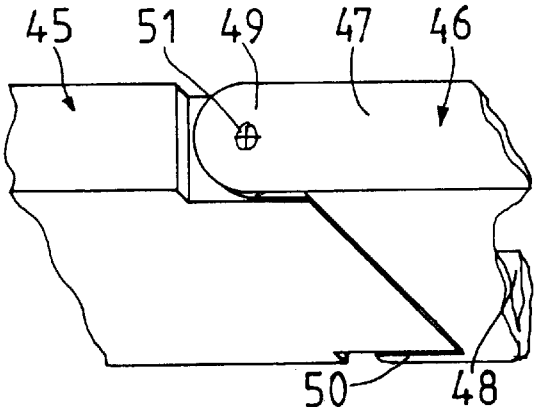

FIGS. 4*a* and 4*b* show an alternative embodiment of the device according to the invention. Again, two adjacent elements 45 and 46 are illustrated partially. Element 46 is provided with end walls 47 and 48 ending in hinge lips 49 and 50 projecting towards the adjacent element 45. The hinge lips 49, 50 cooperate with pivots 51 provided on element 45, in a manner corresponding with the device according to FIG. 3.

Different from the embodiment according to FIG. 3, the embodiment of the device according to FIG. 4 is not provided with abutment shoulders. Element 46 comprises a bottom wall 52 which has a side edge 53 facing the adjacent element 45. When the elements 45 and 46 are hinged by means of the pivots 51 towards the first extended open position illustrated in FIG. 4*b*, said side edge 53 of the bottom wall 52 of element 46 engages the adjacent element 45, especially a side wall 54 thereof facing the element 46. The engagement between side edge 53 of bottom wall 52 and side wall 54 of element 45 is such, that in the open position of the device illustrated in FIG. 4*b* adjacent elements 45 and 46 are horizontally aligned. As explained in respect to the embodiment illustrated in FIG. 3, a further hinged movement beyond the position shown in FIG. 4*b* is prevented.

As appears clearly from FIGS. 4*a* and 4*b* the side edge 53 abuts the side wall 54 along substantially its entire length between the opposite end walls 47 and 48 of the element 46. Thus the pressure is relatively low, and damages of the device are effectively avoided. The side edge 53 might further be part of a side wall of element 46 facing element 45.

Yet another embodiment of the inventive device is illustrated in FIG. 5. It should be noted that according to FIG. 5 adjacent elements 55 and 56 are hingedly connected by means of strips corresponding with the flexible strips 25 according to the state of the art device illustrated in FIGS. 1 and 2.

Device 55 has a side wall 57, whereas device 56 has a side wall 58. The side wall 57 of element 55 carries a hook-like means 59 projecting towards the adjacent element 56. The side wall 58 of element 56 comprises a recess 60 through which the hook-like means 59 extends. The free end of the hook-like means 59 ends in an angled nose 61. In the unrolled state of the device illustrated in FIG. 5 the angled nose 61 engages the inner side of side wall 58 of element 56 below the recess 60, thus preventing a further hinged movement of elements 55 and 56 relative to each other. However, it is possible to relatively move elements 55 and 56 for reaching the rolled-up position, in which the side walls 57 and 58 contact each other. In said rolled-up position the angled nose 61 of the hook-like means 59 is free from the inner side of the side wall 58.

Finally FIG. 6 illustrates partially still a further embodiment of the device according to the invention. Two adjacent container elements 62 and 63 have side walls 64 and 65, respectively. The side walls 64 and 65 are connected by means of a flexible means 66, in the illustrated embodiment a rope. In the extended open position of the device the flexible means 66 is tensioned and a further hinged movement is not allowed. Collapsing, however, the device towards the rolled-up position, in which the side walls 64 and 65 do engage, is possible. Side wall 64 of element 62 is provided with a depression 67 for housing the flexible means 66 in the roll-up position.

Of course, also other flexible means 66 are conceivable, such as strap means or alike. Further it should be noted, that although in FIG. 6 the elements 62 and 63 are illustrated as connected to each other by means of strip means in correspondence with strip means 25 according to the embodiment of FIGS. 1 and 2, also other hinge means may be provided. This applies too for the embodiments according to FIGS. 3, 4, and 5.

While the invention has been illustrated and described with reference to specific embodiments thereof, it will be understood that other embodiments may be envisaged within the scope of the following claims.

It should be appreciated by those skilled in the art that various modifications and variation can be made in the present invention without departing from the scope and spirit of the invention. It is intended that the present invention include such modifications and variations as come within the scope of the appended claims and their equivalents.

I claim:

1. A device for storing or packing objects, comprising:

a plurality of connected substantially rigid container elements wherein said container elements include:

a bottom wall;

a plurality of side walls connected to said bottom wall, wherein said side walls define an open upper side; and pivotal connections which join adjacent said container elements to form a continuous unitary row of said container elements, wherein at least one end of said row of elements is movable between an extended position wherein said container elements are generally oriented in a flat position so that said open upper side is exposed, and a block position of a polygonal shape wherein said container elements are coiled into a block so that at least one container element forms a base on which said block rests; and abutment devices connected between said container elements, said abutment devices configured to limit pivotal movement of said connected container elements so that said container elements have a predetermined range of angular movement with respect to each other when moving from said block position to said extended position.

2. The device for storing or packing items as in claim 1, wherein said abutment devices are integrally formed with said container elements.

3. The device for storing or packing items as in claim 2, wherein said abutment device is a side edge.

4. The device for storing or packing items as in claim 2, wherein said abutment device is a shoulder.

5. The device for storing or packing items as in claim 1, wherein said abutment device is a flexible material of a fixed length attached to said container elements.

6. The device for storing or packing items as in claim 5, wherein said abutment device is stored in a depression in said container element when device for storing or packing items is in said block position.

7. The device for storing or packing items as in claim 1, wherein said abutment device is a hook-like device attached to said container element.

* * * * *